US008446245B2

(12) United States Patent
Wang et al.

(10) Patent No.: US 8,446,245 B2
(45) Date of Patent: May 21, 2013

(54) OVER-CURRENT PROTECTION DEVICE

(75) Inventors: David Shau Chew Wang, Taipei (TW); Yi An Sha, Xindian (TW); Kuo Chang Lo, New Taipei (TW); Tai Kuang Hei, Xinpu Township, Hsinchu County (TW)

(73) Assignee: Polytronics Technology Corp., Hsinchu (TW)

( * ) Notice: Subject to any disclaimer, the term of this patent is extended or adjusted under 35 U.S.C. 154(b) by 126 days.

(21) Appl. No.: 13/235,663

(22) Filed: Sep. 19, 2011

(65) Prior Publication Data

US 2013/0070380 A1 Mar. 21, 2013

(51) Int. Cl.
*H01C 7/10* (2006.01)

(52) U.S. Cl.
USPC ..... 338/21; 338/13; 252/500

(58) Field of Classification Search
USPC ..... 338/21, 20, 13
See application file for complete search history.

(56) References Cited

U.S. PATENT DOCUMENTS

| | | | | |
|---|---|---|---|---|
| 4,689,475 | A * | 8/1987 | Kleiner et al. | 219/553 |
| 5,955,936 | A * | 9/1999 | Shaw et al. | 338/22 R |
| 6,143,206 | A * | 11/2000 | Handa et al. | 252/500 |
| 6,223,423 | B1 * | 5/2001 | Hogge | 29/621 |
| 7,001,538 | B2 * | 2/2006 | Lee et al. | 252/511 |
| 7,382,224 | B2 * | 6/2008 | Wang et al. | 338/22 R |

* cited by examiner

*Primary Examiner* — Kyung Lee
(74) *Attorney, Agent, or Firm* — Egbert Law Offices, PLLC

(57) ABSTRACT

An over-current protection device includes two metal foils and a PTC material layer laminated therebetween. The PTC material layer has a volume resistivity between 0.07 Ω-cm and 0.32 Ω-cm. The PTC material layer includes a crystalline polymer, a conductive ceramic carbide filler of a particle size between 0.1 μm and 50 μm and a volume resistivity less than 0.1 Ω-cm, and a carbon black filler. The weight ratio of the carbon black filler to the conductive ceramic carbide filler is between 1:90 and 1:4. The conductive ceramic carbide filler and the carbon black filler are dispersed in the crystalline polymer. The resistance ratio R100/Ri is between 3 and 20.

17 Claims, 1 Drawing Sheet

OVER-CURRENT PROTECTION DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to an over-current protection device, and more particularly to an over-current protection device with low resistance and superior trip jump behavior.

2. Description of Related Art Including Information Disclosed Under 37 CFR 1.97 and 37 CFR 1.98

Because the resistance of conductive composite materials having a positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g. at least $10^2\Omega$), so as to suppress over-current and protect the cell or the circuit device.

Generally, PTC conductive composite material includes one or more crystalline polymers and a conductive filler. The conductive filler is evenly dispersed in the polymer. The polymer may be polyolefines such as polyethylene, and the conductive filler may be carbon black. However, the carbon black has low conductivity, so that it cannot meet low resistance requirement.

BRIEF SUMMARY OF THE INVENTION

The present application provides an over-current protection device. By adding conductive ceramic carbide filler and conductive carbon black of specific sizes, the over-current protection device has extremely low resistance and superior trip jump behavior.

According to an embodiment, an over-current protection device includes two metal foils and a PTC material layer. The PTC material layer is laminated between the two metal foils, and the volume resistivity is between 0.07 and 0.32 Ω-cm. The PTC material layer includes (1) crystalline polymer, (2) conductive ceramic carbide filler with volume resistivity lower than 0.1 Ω-cm, and (3) conductive carbon black filler. The weight ratio of the conductive carbon black filler and the conductive ceramic carbide filler is between 1:90 and 1:4. The conductive ceramic carbide filler and the conductive carbon black filler are dispersed in the crystalline polymer. The resistance ratio R100/Ri, indicating trip jump or resistance recovery behavior, of the PTC material layer is between 3 and 20.

In an embodiment, metal foils have rough surfaces with nodules and physically contact the PTC material layer. The conductive ceramic carbide filler can be powders with a particle size essentially between 0.01 μm and 100 μm, and preferably between 0.1 μm and 50 μm. The conductive ceramic carbide filler has a volume resistivity below 0.1 Ω-cm and evenly dispersed in the crystalline polymer. The crystalline polymer may be high density polyethylene, low density polyethylene, polypropylene, polyvinylchloride or polyvinyl fluorine.

In an embodiment, the conductive carbon black filler has a particle size between 15 nm and 75 nm, and is 1%-20% of the PTC material layer by weight.

Because the volume resistivity of the conductive ceramic carbide filler is low (less than 0.1 Ω-cm), the PTC material layer containing the filler can have a volume resistivity less than 0.32 Ω-cm.

Two metal electrode sheets may be jointed to the two metal foils of the over-current protection device by reflow or spot-welding process to form an assembly of, for example, axial-leaded, radial-leaded, terminal or surface mounted device. The two metal foils of the over-current protection device can be connected to power to form a circuit, and the PTC material layer will be activated to protect the circuit when over-current occurs.

BRIEF DESCRIPTION OF THE SEVERAL VIEWS OF THE DRAWINGS

The present application will be described according to the appended drawings in which.

DETAILED DESCRIPTION OF THE INVENTION

Figure 1:
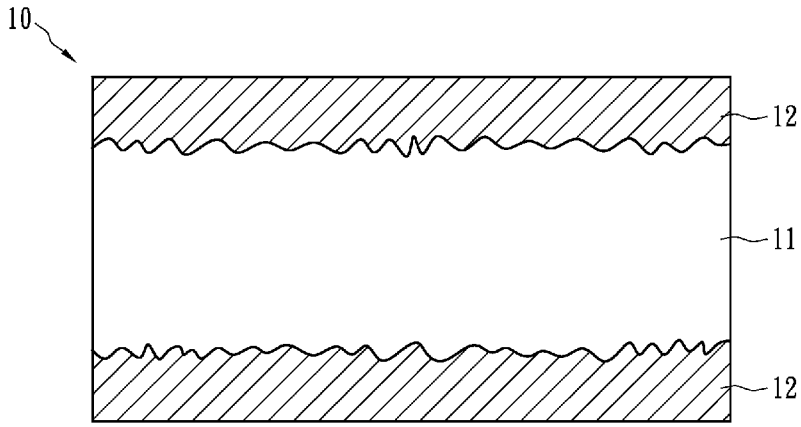
FIG. 1 shows an over-current protection device in accordance with an embodiment of the present application.

The conductivity of conductive composite material is determined by the categories and the amount of the conductive filler. Recently, rechargeable batteries such as lithium batteries and traditional carbon-zinc batteries for consumer electronic apparatuses are being gradually extended their lifetime. Because the conductivity of carbon black is less than that of metal or ceramic filler, conductive ceramic carbide filler is introduced in this application to increase the conductivity. However, because the conductive ceramic carbide filler stacks to form conductive paths, the amount of the conductive paths is decreased when the crystalline polymer of the composite material is heated to be re-crystallized. As a result, the trip jump is too high when the conductive composite material undergoes repetitive over-current or over-temperature events, and consequently the lifetime of battery is shortened.

Because carbon black has rough surface, it can be well adhered to polyolefines and performs better trip jump behavior. In order to decrease the resistance of the over-current protection device after repetitive trips and sustain low volume resistivity of the conductive composite material, conductive ceramic carbide filler and carbon black filler are added in the crystalline polymer of the present application. Because carbon black has superior trip jump behavior and conductive ceramic carbide filler has high conductivity, the over-current protection device can have both features concurrently.

The composition of the over-current protection device in accordance with embodiments Em. 1-8, comparative examples Comp. 1-4, and related manufacturing process are stated below.

The composition and weight (unit: gram) of PTC material layer of the over-current protection device of the present application is shown in Table 1. LDPE-1 is low-density crystalline polyethylene of a density 0.924 g/cm$^3$ and a melting point 113° C. HDPE-1 is high-density crystalline polyethylene of a density 0.943 g/cm$^3$ and a melting point 125° C. HDPE-2 is high density crystalline polyethylene of a density 0.961 g/cm$^3$ and a melting point 131° C. Non-conductive filler uses boron nitride (BN), aluminum nitride (AlN), aluminum oxide ($Al_2O_3$) or magnesium hydroxide ($Mg(OH)_2$). In these embodiments, the conductive filler uses carbon black and titanium carbide (TiC). The weight ratio of the conductive carbon black filler to the conductive ceramic carbide filler is between 1:90 and 1:4. The crystalline polymer is 10%-20% of the PTC material layer by weight. The conductive carbon black filler is 1%-20%, or preferably 6%-18%, of the PTC material layer by weight. The conductive ceramic carbide filler is 65%-90%, or preferably 66%-83%, of the PTC material layer.

TABLE 1

| Material | LDPE-1 | HDPE-1 | HDPE-2 | BN | AIN | $Al_2O_3$ | $Mg(OH)_2$ | Carbon Black | TiC |
|---|---|---|---|---|---|---|---|---|---|
| Em. 1 | — | 10 | 9 | — | — | — | — | 1.5 | 130 |
| Em. 2 | 3 | 16 | — | — | — | — | — | 5 | 135 |
| Em. 3 | 4 | 12.3 | — | — | — | — | — | 15.6 | 69 |
| Em. 4 | 3.5 | — | 15.4 | — | — | — | — | 4.3 | 125 |
| Em. 5 | 5.3 | 12.6 | — | 3.2 | — | — | — | 10.2 | 105 |
| Em. 6 | 4.6 | — | 13.5 | — | — | 4.3 | — | 6.2 | 116 |
| Em. 7 | 3.7 | 15.4 | — | — | — | — | 2.5 | 3.4 | 127 |
| Em. 8 | 4 | — | 14.7 | — | 5 | — | — | 2.9 | 115 |
| Comp. 1 | — | 8.1 | 10.2 | — | — | — | — | — | 130 |
| Comp. 2 | — | 15.2 | 9.3 | — | — | — | — | 29.5 | — |
| Comp. 3 | 5 | 16.5 | — | — | 10 | — | — | — | 140 |
| Comp. 4 | — | 5 | 17.6 | 5.5 | — | — | — | — | 135 |

The manufacturing process of the over-current protection device is described as follows. The raw material is fed into a blender (HAAKE 600) at 160° C. for two minutes. The procedure of feeding the raw material includes adding the crystalline polymers into the blender according to Table 1; after blending for a few seconds, then adding the conductive ceramic carbide filler, e.g., titanium carbide, with particle size distribution between 0.1 μm and 50 μm and/or carbon black powder with particle size between 0.1 μm and 30 μm. The rotational speed of the blender is set at 40 rpm. After blending for three minutes, the rotational speed is increased to 70 rpm. After blending for 7 minutes, the mixture in the blender is drained and thereby forms a conductive composition with positive temperature coefficient (PTC) behavior.

The above conductive composition is loaded symmetrically into a mold with outer steel plates and a 0.35 mm and 0.2 mm thick middle, wherein the top and the bottom of the mold are disposed with a Teflon cloth. The mold loaded with the conductive composition is pre-pressed for three minutes at 50 kg/cm$^2$, 180° C. Then the generated gas is exhausted and the mold is pressed for 3 minutes at 100 kg/cm$^2$, 180° C. Next, the press step is repeated once at 150 kg/cm$^2$, 180° C. for three minutes to form a PTC material layer 11 (refer to FIG. 1). In an embodiment, the thickness of the PTC material layer 11 is greater than 0.1 mm, or preferably greater than 0.2 mm or 0.3 mm.

Figure 2:
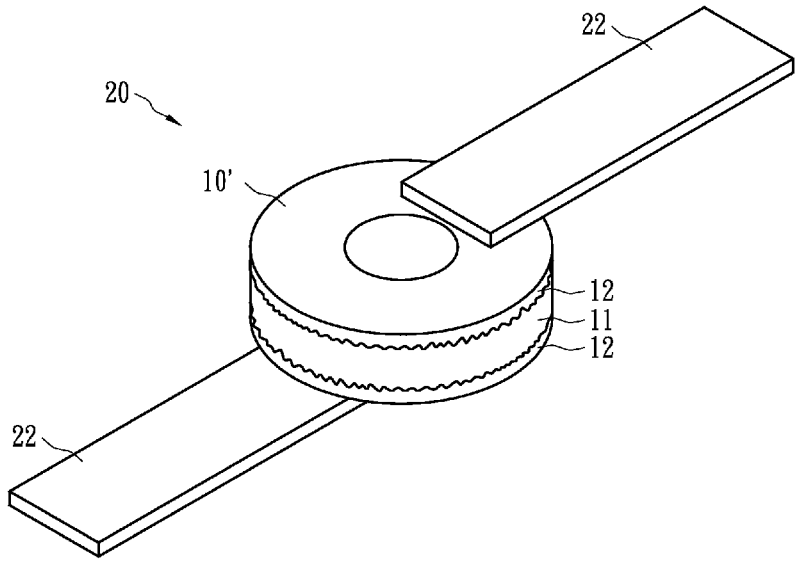
FIG. 2 shows an over-current protection device in accordance with another embodiment of the present application.

The PTC material layer 11 is cut into many pieces each with an area of 20×20 cm$^2$. Then, two metal foils 12 physically contact the top surface and the bottom surface of the PTC material layer 11, in which the two metal foils 12 are symmetrically placed upon the top surface and the bottom surface of the PTC material layer 11. In an embodiment, each metal foil 12 has a rough surface with plural nodules to physically contact the PTC material layer 11. Next, Teflon cloths and the steel plates are pressed to form a multi-layered structure 10. The multi-layered structure 10 is again pressed for three minutes at 70 kg/cm$^2$, 180° C. Next, the multi-layered structure 10 is punched or cut to form a ring type over-current protection device 10' with an outer diameter of 16 mm and an inner diameter of 10 mm. After that, two metal electrode sheets 22 are jointed to the metal foils 12 by solder reflow to form an axial-leaded over-current protection device 20, as shown in FIG. 2. Table 2 shows test results of the over-current protection device.

The volume resistivity (ρ) of the PTC material layer 11 is calculated by formula (1) below.

$$\rho = \frac{R \times A}{L} \tag{1}$$

where R, A, and L indicate the resistance (Ω), the area (cm$^2$), and the thickness (cm) of the PTC material layer 11, respectively. Substituting the initial resistance Ri of 0.0035Ω. (refer to Em. 1 of Table 2 below), the area of 122.46 mm$^2$ (=(8×8×3.14)−(5×5×3.14) $10^{-2}$ cm$^2$), and the thickness of 0.3 mm for R, A, and L in formula (1), respectively, a volume resistivity (ρ) of 0.1428 Ω-cm is obtained. Likewise, the resistivity values of Em. 2-8 can be obtained, in which ρ=0.2408 Ω-cm for Em. 2, ρ=0.2571 Ω-cm for Em. 3, ρ=0.1714 Ω-cm for Em. 4, ρ=0.3183 Ω-cm for Em. 5, ρ=0.1387 Ω-cm for Em. 6, ρ=0.1714 Ω-cm for Em. 7, and ρ=0.2 Ω-cm for Em. 8. All of these volume resistivity values are less than the volume resistivity ρ=0.3469 Ω-cm of Comp. 2 which uses carbon black only. According to Table 2, the volume resistivity of the embodiments is between 0.07 Ω-cm and 0.32 Ω-cm, preferably between 0.1 Ω-cm and 0.3 Ω-cm, and most preferably between 0.12 Ω-cm and 0.28 Ω-cm.

TABLE 2

| | Area | Thickness | Ri | ρ | Resistance @ Trip state | | | |
|---|---|---|---|---|---|---|---|---|
| | ($mm^2$) | (mm) | (mΩ) | (Ω-cm) | R10 | R100 | R300 | R100/Ri |
| Em. 1 | 122.46 | 0.3 | 3.5 | 0.1428 | 15 mΩ | 36 mΩ | 77 mΩ | 10.2 |
| Em. 2 | 122.46 | 0.3 | 5.9 | 0.2408 | 20.6 mΩ | 36.6 mΩ | 80 mΩ | 6.2 |
| Em. 3 | 122.46 | 0.3 | 6.3 | 0.2571 | 12.8 mΩ | 40.9 mΩ | 68.6 mΩ | 6.5 |
| Em. 4 | 122.46 | 0.3 | 4.2 | 0.1714 | 14.6 mΩ | 39.8 mΩ | 91.4 mΩ | 9.5 |
| Em. 5 | 122.46 | 0.3 | 7.8 | 0.3183 | 15.8 mΩ | 93.6 mΩ | 170.3 mΩ | 12.0 |
| Em. 6 | 122.46 | 0.3 | 3.4 | 0.1387 | 16.9 mΩ | 20.3 mΩ | 66.4 mΩ | 5.9 |
| Em. 7 | 122.46 | 0.3 | 4.2 | 0.1714 | 11.2 mΩ | 46.8 mΩ | 104.4 mΩ | 11.1 |
| Em. 8 | 122.46 | 0.3 | 4.9 | 0.2000 | 17.7 mΩ | 79.6 mΩ | 134.5 mΩ | 15.7 |
| Comp. 1 | 122.46 | 0.3 | 1.7 | 0.0693 | 9.5 mΩ | 114 mΩ | 375 mΩ | 67.1 |
| Comp. 2 | 122.46 | 0.3 | 8.5 | 0.3469 | 8.5 mΩ | 14.5 mΩ | 19 mΩ | 1.7 |
| Comp. 3 | 122.46 | 0.3 | 2.5 | 0.1020 | 8.2 mΩ | 106 mΩ | 248 mΩ | 42.4 |
| Comp. 4 | 122.46 | 0.3 | 1.8 | 0.0734 | 9 mΩ | 95 mΩ | 187 mΩ | 52.7 |

R10, R100 and R300 indicate the resistances of PTC material layer after tripping 10 times, 100 times and 300 times, respectively. The resistances after tripping 100 times are used for evaluating the trip jump behavior. The ratio R100/Ri serves as an index showing the trip jump characteristic, where R100 is the resistance after tripping 100 times, and Ri is the initial resistance. According to Em. 1-8, R100/Ri is between 3 and 20, preferably between 4 and 16, and most preferably between 5 and 13. However, R100/Ri of Comp. 1 that only uses titanium carbide is 67.1, and R100/Ri of Comp. 3 and Comp. 4 using aluminum nitride or boron nitride in addition to titanium carbide and excluding carbon black are greater than 40. Clearly, the devices of the present application can improve the trip jump behavior in comparison with the cases only using ceramic filler. Comp. 2 only using carbon black as conductive filler has an initial resistance Ri of 8.5 mΩ. The initial resistances Ri of the embodiments of the present application are less than 8 mΩ, or preferably less than 7 mΩ and therefore the addition of ceramic carbide filler of the present application can effectively decrease the initial resistance. In summary, Em. 1-8 using ceramic carbide filler together with carbon black have better trip jump characteristics in comparison with Comp. 1, 3 and 4 without adding carbon black. Em. 1-8 using ceramic carbide filler and carbon black have lower initial resistances and resistivity values in comparison with Comp. 2 only having carbon black.

In addition to the materials listed in Table 1, PTC material layer may use crystalline polyolefines (e.g., high-density polyethylene (HDPE), medium-density polyethylene, low-density polyethylene (LDPE), polyvinyl wax, vinyl polymer, polypropylene, polyvinyl chlorine and polyvinyl fluoride), copolymer of olefin monomer and acrylic monomer (e.g., copolymer of ethylene and acrylic acid or copolymer of ethylene and acrylic resin) or copolymer of olefin monomer and vinyl alcohol monomer (e.g., copolymer of ethylene and vinyl alcohol), and may include one or more crystalline polymer materials. The LDPE can be polymerized using Ziegler-Natta catalyst, Metallocene catalyst or the like, or can be copolymerized by vinyl monomer and other monomers such as butane, hexane, octane, acrylic acid, or vinyl acetate.

The conductive ceramic carbide filler may be titanium carbide, tungsten carbide, vanadium carbide, boron carbide silicon carbide, geranium carbide, tantalum carbide, zirconium carbide, chromium carbide, or molybdenum carbide, and may be of various shapes, e.g., spherical, debris, flake, or polygonal shape. The particle size of the conductive ceramic carbide filler is essentially between 0.1 μm and 50 μm.

Moreover, when the resistivity of the PTC material is less than 1 Ω-cm, it cannot withstand a voltage higher than 12V due to the low resistance. In order to increase voltage endurance, Em. 5-8 add non-conductive filler, which usually is inorganic compound, to the PTC material and control the thickness of the PTC material layer to be greater than 0.1 mm. As a result, the low resistance PTC material layer can withstand a voltage less than or equal to 28V, preferably between 6V and 28V, and most preferably between 12V and 28V, and withstand a current less than or equal to 50 amperes.

According to the present application, the conductive ceramic carbide filler and the conductive carbon black filler of specific sizes are added to the crystalline polymer, by which the over-current protection device has superior volume resistivity and trip jump behavior. Besides, non-conductive filler can be further added, so as to increase voltage endurance.

The above-described embodiments of the present invention are intended to be illustrative only. Numerous alternative embodiments may be devised by persons skilled in the art without departing from the scope of the following claims.

We claim:

1. An over-current protection device, comprising:

two metal foils; and a PTC material layer laminated between the two metal foils and having a volume resistivity between 0.07 Ω-cm and 0.32 Ω-cm, the PTC material layer comprising:

at least one crystalline polymer;

a conductive ceramic carbide filler dispersed in the crystalline polymer, wherein the conductive ceramic carbide filler has a particle size between 0.1 μm and 50 μm and a volume resistivity less than 0.1 Ω-cm; and a conductive carbon black filler dispersed in the crystalline polymer, wherein a weight ratio of the conductive carbon black filler to the conductive ceramic carbide filler is between 1:90 and 1:4;

wherein a resistance ratio R100/Ri is between 3 and 20, where Ri is an initial resistance of the PTC material layer, and R100 is the resistance of the PTC material layer after the PTC material layer is tripped 100 times.

2. The over-current protection device of claim 1, wherein the conductive ceramic carbide filler is 65%-90% of the PTC material layer by weight, and the conductive carbon black filler is 1%-20% of the PTC material layer by weight.

3. The over-current protection device of claim 1, wherein the conductive ceramic carbide filler is 66%-83% of the PTC material layer by weight, and the conductive carbon black filler is 6%-18% of the PTC material layer by weight.

4. The over-current protection device of claim 1, wherein the PTC material layer has a volume resistivity between 0.1 and 0.3 Ω-cm.

5. The over-current protection device of claim 1, wherein the resistance ratio R100/Ri is between 4 and 16.

6. The over-current protection device of claim 1, wherein the crystalline polymer is selected from the group consisting of polyolefines, copolymer of olefin monomer and acrylic monomer, copolymer of olefin monomer and vinyl alcohol monomer, and the mixture thereof.

7. The over-current protection device of claim 1, wherein the crystalline polymer is selected from the group consisting of high-density polyethylene, medium-density polyethylene, low-density polyethylene, polyvinyl wax, vinyl polymer, polypropylene, polyvinyl chlorine, polyvinyl fluoride, copolymer of ethylene and acrylic acid, copolymer of ethylene and acrylic resin, copolymer of ethylene and vinyl alcohol, and the mixture thereof.

8. The over-current protection device of claim 1, wherein the conductive ceramic carbide filler is selected from the group consisting of tungsten carbide, vanadium carbide, titanium carbide, boron carbide, silicon carbide, germanium carbide, tantalum carbide, zirconium carbide, chromium carbide, molybdenum carbide, and the mixture thereof.

9. The over-current protection device of claim 1, wherein the conductive ceramic carbide filler is of spherical, flake, debris or polygonal shape.

10. The over-current protection device of claim 1, wherein the conductive carbon black filler has a particle size between 15 nm and 75 nm.

11. The over-current protection device of claim 1, wherein the conductive carbon black filler is 1%-20% of the PTC material layer by weight.

12. The over-current protection device of claim 1, wherein the PTC material layer further comprises a non-conductive filler.

13. The over-current protection device of claim 12, wherein the non-conductive filler is selected from the group consisting of boron nitride, aluminum nitride, aluminum oxide, magnesium hydroxide and the mixture thereof.

14. The over-current protection device of claim 12, wherein the non-conductive filler has a particle size between 0.1 μm and 30 μm.

15. The over-current protection device of claim 12, wherein the over-current protection device can withstand a voltage between 12V and 28V and a current equal to or less than 50 amperes.

16. The over-current protection device of claim 1, wherein the PTC material layer has a thickness greater than 0.1 mm.

17. The over-current protection device of claim 1, further comprising two metal electrode sheets that are connected to the two metal foils.

* * * * *